US006278859B1

(12) United States Patent
Nagano

(10) Patent No.: US 6,278,859 B1
(45) Date of Patent: Aug. 21, 2001

(54) IMAGE FORMING APPARATUS WITH ALIGNED TRANSFER CONVEYING UNITS

(75) Inventor: Toshiyuki Nagano, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/351,855

(22) Filed: Jul. 14, 1999

(30) Foreign Application Priority Data

Jul. 21, 1998 (JP) ..... 10-221064

(51) Int. Cl.[7] ..... G03G 15/16
(52) U.S. Cl. ..... 399/316; 399/400
(58) Field of Search ..... 399/311, 315, 399/316, 396, 400

(56) References Cited

U.S. PATENT DOCUMENTS 5,144,383 * 9/1992 Murano et al. ..... 399/316
5,187,528 * 2/1993 Nishikawa et al. ..... 399/396
5,448,343 * 9/1995 Nakamichi et al. ..... 399/315 X
5,745,832 * 4/1998 Yoshiuchi ..... 399/396 X
5,758,247 * 5/1998 Yanashima et al. ..... 399/315 X
5,812,920 * 9/1998 Mizude et al. ..... 399/316

* cited by examiner

*Primary Examiner*—Fred L. Braun
(74) *Attorney, Agent, or Firm*—Fitzpatrick, Cella, Harper & Scinto

(57) ABSTRACT

An image forming apparatus has a transfer unit that transfers a toner image formed and born on an image bearing body onto a transfer material and a fixing unit that fixes the toner image transferred by the transfer unit to the transfer material. A first transfer material supporting unit supports a non-transfer surface of the transfer material separated from the image bearing body at a transfer material outlet of the transfer unit. A second transfer material supporting unit defines an inlet height of the transfer material at the fixing unit and a third transfer material supporting unit is disposed between the first and second transfer material supporting units. The first, second and third transfer material supporting units are located on a substantially straight line.

10 Claims, 5 Drawing Sheets

IMAGE FORMING APPARATUS WITH ALIGNED TRANSFER CONVEYING UNITS

BACKGROUND OF THE INVENTION

1. Field of the Invention

The present invention relates to an image forming apparatus of transfer type such as a copying machine, a laser beam printer (LBP) and the like, having a transfer means for transferring a toner image onto a transfer material, which toner image was formed and born on an image bearing member such as an electrophotographic photosensitive body, an electrostatic recording dielectric body, a magneto-recording magnetic body and the like by means of an appropriate image forming process means such as an electrophotographic process, an electrostatic recording process, a magnetic recording process and the like, and a fixing means for fixing the toner image onto the transfer material.

2. Related Background Art

FIG. 4 schematically shows an example of an image forming apparatus of the transfer type.

In this example, an image bearing 101 is constituted by a rotary drum-shaped electrophotographic photosensitive body. The photosensitive body 101 is rotated at a predetermined peripheral speed (process speed) in a clockwise direction shown by the arrow and is uniformly charged with predetermined polarity and potential by means of a primary charger 102.

Then, the charged surface is illuminated by image exposure light 103 from an image exposure means (for example, a projection exposure apparatus for an original image or a scanning exposure apparatus using image-modulated laser beam), with the result that potential of an exposed bright portion is reduced to form an electrostatic latent image corresponding to the exposure image information on the surface of the photosensitive body.

Then, the electrostatic latent image is subjected to normal development or reversal development by means of a developing device 104, thereby forming a toner image.

The toner image is transferred onto a transfer material S by a transfer means 105 at a transfer position (transfer portion) T. In this example, the transfer means 105 comprises a transfer charger having a discharge opening portion opposed to the photosensitive body 101 with a predetermined gap therebetween (non-contact type). The transfer position is defined between the photosensitive body 101 and the transfer charger 105.

The transfer materials S are supplied and separated one by one from a sheet feeding cassette (not shown), and the separated transfer material is sent to the transfer position at a predetermined control timing through a pair of registration rollers 106 and a transfer guide 107. The pair of registration rollers 106 serve to feed the transfer material S to the transfer position T at a timing such that a leading edge of the transfer material S just reaches the transfer position T when a leading edge of the toner image formed on the surface of the rotating photosensitive body 101 reaches the transfer position T.

After the leading edge of the transfer material S reaches the transfer position T and before a trailing edge of the transfer material S is passed by the transfer position T, a predetermined voltage is applied to the transfer charger 105 so that a back surface of the transfer material S being passed through the transfer position T is charged with polarity opposite to charging polarity of the toner. As a result, the transfer material S is electrostatically adhered (electrostatic adsorption) to the surface of the rotating photosensitive body 101 to be conveyed through the transfer position T; meanwhile, the toner image formed on the surface of the photosensitive body 101 is electrostatically transferred onto the surface of the transfer material S.

The transfer material S electrostatically adhered to the surface of the rotating photosensitive body 101 and left from the transfer position T is subjected to electricity removal by means of a separation charger 108, with the result that the transfer material is separated from the surface of the rotating photosensitive body 101. The back surface (non-imaged surface) of the transfer material S is separated from the surface of the rotating photosensitive body 101 and is contacted with and supported by a transfer support portion 110 disposed at a transfer material outlet of the transfer position T and is then sent to a convey belt device 111, where the transfer material is rested on a convey belt 112 with the toner-imaged surface facing upwardly.

After the transfer material is separated, transfer residual toner and foreign matters remaining on the surface of the rotating photosensitive body 101 are removed by a cleaning device 109 to clean the photosensitive body for preparation for next image formation.

The convey belt 112 of the convey belt device 111 is an endless belt mounted around and between a drive roller 113, a driven roller 114 and a tension roller 115 with predetermined tension, and an upper belt portion (upper run) of the convey belt on which the transfer material S rests is rotated at a predetermined peripheral speed from the transfer position T toward a fixing device 118. A suction fan 116 is disposed inside of the endless convey belt 112 to generate an absorbing force directing from the upper belt portion toward the interior of the convey belt. The transfer material S resting on the upper belt portion of the convey belt 112 is adsorbed and held by the upper belt portion under the action of the suction fan 116, so that the transfer material is conveyed by the shifting movement of the belt through a convey support portion 117. Then, the transfer material is shifted from the convey belt device 111 toward a fixing inlet guide 119 of the fixing device 118 to enter into a fixing nip portion (fixing position) N between a fixing roller 120 and a pressure roller 121, where the toner image is fixed to the transfer material. Thereafter, the transfer material is discharged onto a sheet discharge tray 124 by pairs of sheet discharge rollers 122, 123.

The convey support portion 117 defines a point where the transfer material S is separated from the convey belt 112, which point is substantially the same as a point where the convey belt 112 contacts with the drive roller 113.

The fixing inlet guide 119 supports the back surface of the transfer material S and serves to direct the leading edge of the transfer material into a transfer material inlet of the fixing nip N, and a downstream (in a transfer material conveying direction) upper end of the fixing inlet guide constitutes a fixing inlet support portion for defining a transfer material inlet height of the fixing device 118.

In this system, in order not to transmit shock (fixing entering shock) generated when the leading edge of the transfer material enters into the fixing nip N to the transfer position T, the convey support portion 117 is located below a line connecting between the upper end (fixing inlet support portion) of the fixing inlet guide 119 and an upper end of the transfer support portion 110, so that the transfer material S is curved downwardly and is strongly adsorbed by the convey belt 112 under the action of the suction fan 116, thereby preventing transfer deviation due to entering shock of the leading edge of the transfer material into the fixing nip N.

Further, a distance between the fixing nip N and the transfer position T is selected to be equal to or greater than A4R length (293 mm) so that possibility of shock is eliminated regarding transfer materials having half sizes (203 to 210 mm) such as A4 size and LTR size which have high frequency of usage.

Further, in order to prevent transfer deviation due to leaving shock (registration leaving shock) generated when the trailing end of the transfer material leaves the pair of registration rollers 106, the adsorbing force of the suction fan 116 is selected to be greater, and a relationship between speeds is selected as follows:

fixing speed≦convey belt speed
= registration roller speed so that the transfer material is not pulled and the adsorbing force is increased, thereby preventing the leaving shock.

However, in the above-mentioned conventional example, since the distance between the transfer position T and the fixing nip N must be greater, a width of a main body of the image forming apparatus is increased, and, since the adsorbing force of the fan must be stronger, cost of the convey portion is increased.

SUMMARY OF THE INVENTION

An object of the present invention is to eliminate the above-mentioned conventional drawbacks in image forming apparatuses of transfer type and to prevent fixing entering shock and registration leaving shock by designing to omit a convey portion having a convey belt and a suction fan disposed between a transfer position T and a fixing position N, thereby making the image forming apparatus more compact and cheaper.

The present invention provides an image forming apparatus comprising a transfer means for transferring a toner image formed and born on an image bearing body onto a transfer material, a fixing means for fixing the toner image transferred by the transfer means onto the transfer material, a first transfer material supporting means for supporting a non-transfer surface of the transfer material separated from the image bearing body at a transfer material outlet of the transfer means, a second transfer material supporting means disposed at a transfer material inlet of the fixing means and adapted to support the non-transfer surface of the transfer material, an d a third transfer material supporting means disposed between the first and second transfer material supporting means and adapted to support the non-transfer surface of the transfer material, and the first, second and third transfer material supporting means are located on a substantially straight line and a transfer material supporting surface of the second transfer material supporting means is fixed.

The present invention further provides an image forming apparatus comprising a transfer means for transferring a toner image formed and born on an image bearing body onto a transfer material, a fixing means for fixing the toner image transferred by the transfer means onto the transfer material, a first support portion having a first fixed transfer material supporting surface for supporting a non-transfer surface of the transfer material separated from the image bearing body at a transfer material outlet of the transfer means, a second support portion having a second transfer material supporting surface disposed at a transfer material inlet of the fixing means, and third support portion having a third transfer material supporting surface disposed between the first and second support portions and adapted to support the transfer material, and the first, second and third transfer material supporting surfaces are located on a substantially straight line, and the first, second and third transfer material supporting surfaces are disposed below a transfer position of the transfer means and a fixing position of the fixing means.

The present invention further provides an image forming apparatus comprising a transfer means for transferring a toner image formed and born on an image bearing body onto a transfer material, a transfer material conveying means for conveying the transfer material to a transfer position of the transfer means, a fixing means for fixing the toner image transferred by the transfer means onto the transfer material while conveying the transfer material, a first support portion having a first transfer material supporting surface for supporting a non-transfer surface of the transfer material separated from the image bearing body at a transfer material outlet of the transfer means, a second support portion having a second transfer material supporting surface disposed at a transfer material inlet of the fixing means, and a third support portion having a third transfer material supporting surface disposed between the first and second support portions and adapted to support the transfer material, and the first, second and third transfer material supporting surfaces are located on a substantially straight line, and the first, second and third transfer material supporting surfaces are disposed below the transfer position of the transfer means and a fixing position of the fixing means, and a transfer material conveying speed of the transfer material conveying means is equal to or smaller than a transfer material conveying speed of the fixing means.

The present invention further provides an image forming apparatus comprising a transfer means for transferring a toner image formed and born on an image bearing body onto a transfer material, a transfer material conveying means for conveying the transfer material to a transfer position of the transfer means, a fixing means for fixing the toner image transferred by the transfer means onto the transfer material while conveying the transfer material, a first transfer material supporting means for supporting a non-transfer surface of the transfer material separated from the image bearing body at a transfer material outlet of the transfer means, a second transfer material supporting means disposed at a transfer material inlet of the fixing means and adapted to support the transfer material, and a third transfer material supporting means disposed between the first and second transfer material supporting means, and the first, second and third transfer material supporting means are located on a substantially straight line, and a nip of the transfer material conveying means, the transfer position of the transfer means and a fixing position of the fixing means are located on a substantially straight line, and the first, second and third transfer material supporting means are disposed below the transfer position of the transfer means and the fixing position of the fixing means, and a transfer material conveying speed of the transfer material conveying means is equal to or smaller than a transfer material conveying speed of the fixing means.

The present invention further provides an image forming apparatus comprising a transfer means for transferring a toner image formed and born on an image bearing body onto a transfer material, a transfer material conveying means for conveying the transfer material to a transfer position of the transfer means, a fixing means for fixing the toner image transferred by the transfer means onto the transfer material while conveying the transfer material, a first transfer material supporting means for supporting a non-transfer surface of the transfer material separated from the image bearing body at a transfer material outlet of the transfer means, a second transfer material supporting means disposed at a transfer material inlet of the fixing means and adapted to support the transfer material, a third transfer material supporting means disposed between the first and second transfer material supporting means, and a fourth transfer material supporting means disposed between the transfer material conveying means and the transfer position of the transfer means, and the first, second and third transfer material supporting means are located on a substantially straight line, and, a nip of the transfer material conveying means, the transfer position of the transfer means and a fixing position of the fixing means are located on a substantially straight line, and the fourth transfer material supporting means is disposed above the latter straight line, and the first, second and third transfer material supporting means are disposed below the transfer position of the transfer means and the fixing position of the fixing means, and a transfer material conveying speed of the transfer material conveying means is equal to or smaller than a transfer material conveying speed of the fixing means.

The present invention further provides an image forming apparatus comprising a transfer means for transferring a toner image formed and born on an image bearing body onto a transfer material, a transfer material conveying means for conveying the transfer material to a transfer position of the transfer means, a fixing means for fixing the toner image transferred by the transfer means and born on the transfer material while conveying the transfer material, a first transfer material supporting means for supporting a non-transfer surface of the transfer material separated from the image bearing body at a transfer material outlet of the transfer means, a second transfer material supporting means disposed at a transfer material inlet of the fixing means and adapted to support the transfer material, a third transfer material supporting means disposed between the first and second transfer material supporting means, and a fourth transfer material supporting means disposed between the transfer material conveying means and the transfer position of the transfer means, and wherein the first, second and third transfer material supporting means are located on a substantially straight line, and, a nip of the transfer material conveying means, the transfer position of the transfer means and a fixing position of the fixing means are located on a substantially straight line, and the fourth transfer material supporting means is disposed above the latter straight line, and the first, second and third transfer material supporting means are disposed below the transfer position of the transfer means and the fixing position of the fixing means, and a transfer material conveying speed of the transfer material conveying means is equal to or smaller than a transfer material conveying speed of the fixing means, and a distance between the transfer material conveying means and the fixing means is smaller than a minimum size of a transfer material which can be conveyed in the image forming apparatus.

That is to say, to achieve the above object, in summary, the present invention is characterized in that (1) the first transfer material supporting means (transfer material supporting portion), the third transfer material supporting means and the second transfer material supporting means (fixing inlet supporting portion) are located on the substantially straight line, (2) the distance between the fixing position of the fixing means and the nip of the transfer material conveying means is smaller than the minimum size of the transfer material which can be conveyed in the image forming apparatus, and (3) the transfer material conveying speed (fixing roller speed) of the fixing means is equal to or greater than the transfer material conveying speed (registration roller speed) of the transfer material conveying means (registration rollers), so that the fixing entering shock and the registration leaving shock are eliminated by designing to omit a convey portion having a convey belt and a suction fan disposed between the transfer position and the fixing position, thereby making the image forming apparatus more compact and cheaper.

DESCRIPTION OF THE PREFERRED EMBODIMENTS

Figure 1:
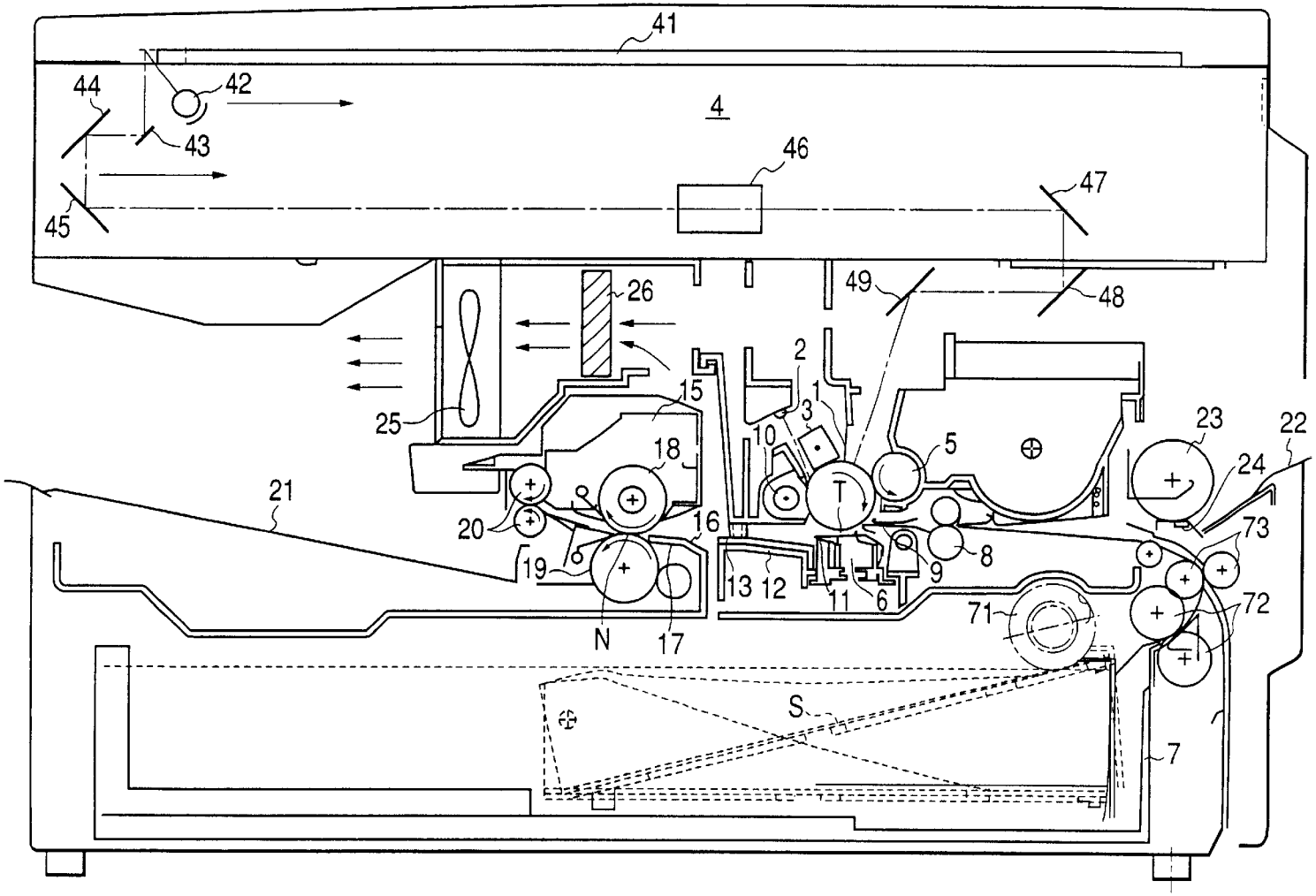
FIG. 1 is a view showing a schematic construction of an image forming apparatus according to an embodiment of the present invention.
Figure 2:
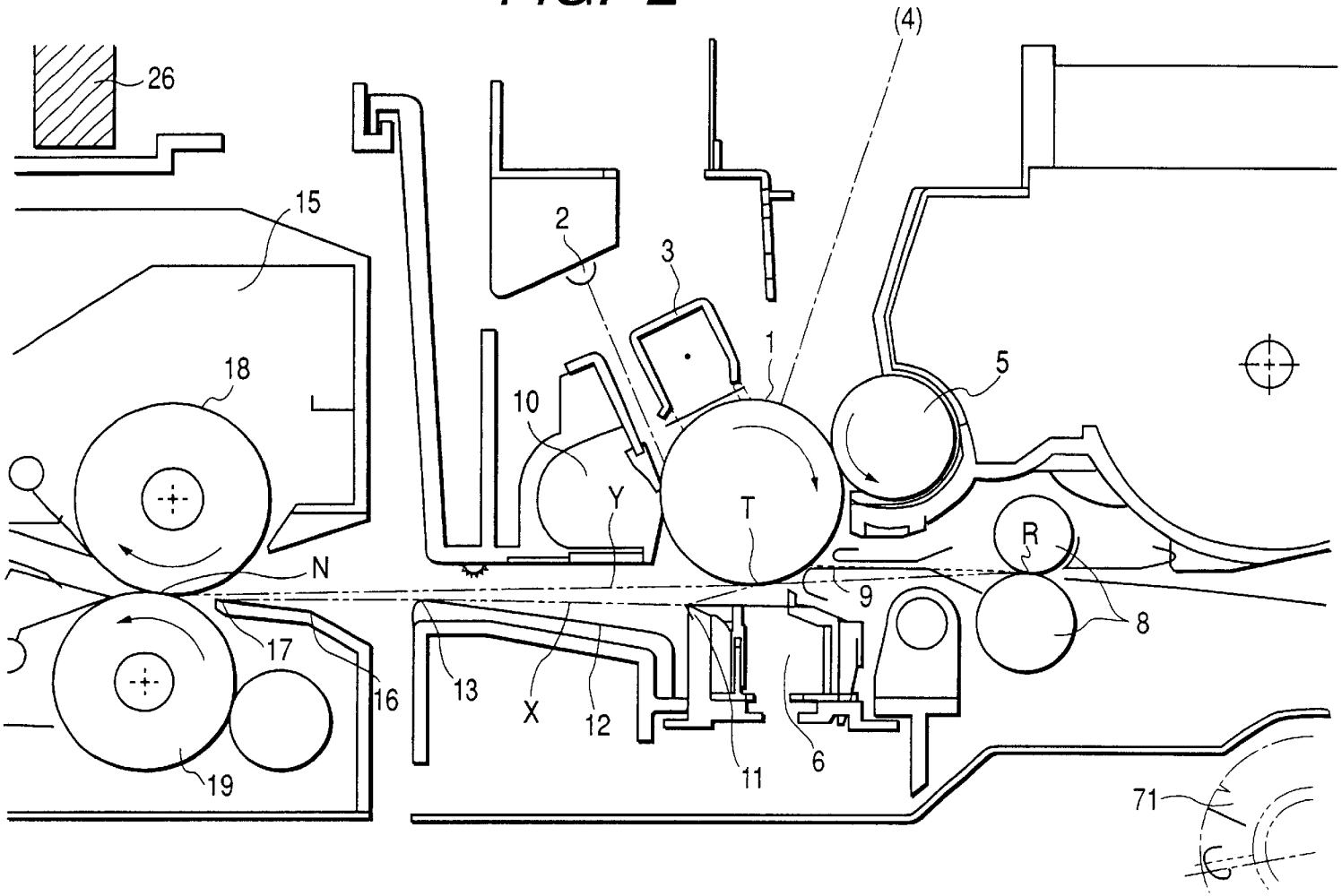
FIG. 2 is a partial enlarged view of a main part of FIG. 1.

FIGS. 1 and 2 are schematic constructional views of an image forming apparatus according to an embodiment of the present invention. The image forming apparatus according to the illustrated embodiment is embodied as a copying machine of type in which an original plate is fixed and an optical system is shifted and an electrophotographic process is utilized.

A rotary drum-shaped electrophotographic photosensitive body 1 as an image bearing body is rotated in a clockwise direction shown by the arrow at a predetermined peripheral speed (process speed).

A pre-exposure device 2 serves to uniformly expose a peripheral surface of the rotating image bearing body 1 to remove electricity from the image bearing body, thereby removing electrical memory of previous image formation, and then, the peripheral surface of the image bearing body is uniformly charged with predetermined polarity and potential by means of a primary charger 3.

An image exposure device 4 according to the illustrated embodiment is of type in which an original plate is fixed and an optical system is shifted. That is to say, an original (not shown) is rested on a fixed original glass plate 41 with an imaged surface thereof facing downwardly in accordance with a predetermined resting reference, and an original pressing plate (not shown) is urged against the original. An original illuminating lamp 42 and a first shiftable mirror 43 are waiting at their home positions as shown and are shifted toward one direction at a predetermined control timing along a lower surface of the original glass plate 41 at a predetermined speed from a left side to a right side of the original glass plate to illuminate and scan the downwardly directed imaged surface of the original rested on the original glass plate 41. Second and third shiftable mirrors 44, 45 are shifted toward one direction in synchronism with the original illuminating lamp 42 and the first shiftable mirror 43 at a speed of half (½) of the shifting speed of the original illuminating lamp 42 and the first shiftable mirror 43. Light reflected from the downwardly directed imaged surface illuminated by the reciprocally shifting original illuminating lamp 42 is focused (slit exposure of original image) onto the uniformly charged surface of the rotating photosensitive body 1 through the first shiftable mirror 43, second shiftable mirror 44, third shiftable mirror 45, projection lens 46, a fourth fixed mirror 47, fifth fixed mirror 48 and sixth fixed mirror 49, thereby forming an electrostatic latent image corresponding to the original image on the peripheral surface of the rotating photosensitive body 1. When the original illuminating lamp 42, first shiftable mirror 43, second shiftable mirror 44 and third shiftable mirror 45 are shifted in one direction up to predetermined controlled terminals, they start reverse shifting movements to return to their home positions.

Then, the electrostatic latent image on the photosensitive body 1 is developed by a developing device 5 as a toner image.

The toner image is transferred onto a transfer material (sheet) S by a transfer means 6 at a transfer position (transfer portion) T. The transfer means 6 according to the illustrated embodiment comprises a transfer charger having a discharge opening portion opposed to the photosensitive body 1 with a predetermined gap therebetween (non-contact type). The transfer position is defined as a portion between the photosensitive body 1 and the transfer charger 6.

The transfer materials S are stacked and contained in a sheet feeding cassette 7 and are supplied one by one from the cassette 7 by a sheet feed roller 71 and a pair of separation rollers 72, and the separated transfer material is pulled by a pair of pull rollers 73 and then is sent to a pair of registration rollers (first transfer material conveying means) 8. Then, the transfer material is sent from the pair of registration rollers 8 at a predetermined control timing and is fed to the transfer position T while being supported by a transfer guide (fourth transfer material supporting means) 9 and is closely contacted with the surface of the photosensitive body 1. The pair of registration rollers 8 feeds the transfer material S to the transfer position T at a timing that a leading edge of the transfer material S just reaches the transfer position T when a leading edge of the toner image formed on the surface of the rotating photosensitive body 1 reaches the transfer position T (image leading edge registration). Further, the pair of registration rollers 8 also serves to correct skew-feeding of the transfer material S.

During a time period from when the leading edge of the transfer material S reaches the transfer position T to when a trailing edge of the transfer material S leaves the transfer position T, a predetermined voltage is applied to the transfer charger 6 to charge the back surface of the transfer material S passing through the transfer position T with polarity opposite to charging polarity of the toner. As a result, the transfer material S is closely contacted with the surface of the rotating photosensitive body 1 electrostatically (electrostatic adsorption) to be passed through the transfer position T; meanwhile, the toner image formed on the surface of the photosensitive body 1 is electrostatically transferred onto a front surface of the transfer material S.

The transfer material S electrostatically adsorbed on the surface of the photosensitive body 1 which has passed through the transfer position T is separated from the surface of the photosensitive body 1 by a separation means, and the back surface (non-transfer surface) of the separated transfer material is supported by a transfer supporting portion (first supporting surface) 11 as a first transfer material supporting means disposed at a transfer material outlet of the transfer position T and rides on a fixed beltless convey guide portion 12 as a third transfer material supporting means, so that the transfer material passes through a top portion (third supporting surface) of the convey guide portion 12 and then enters from the convey guide portion 12 into a fixing inlet guide 16 of a fixing device 15 while being supported by the top portion 13 (in the illustrated embodiment, the top portion 13 of the convey guide portion 12 is defined as a supporting portion as the third transfer material supporting means). Then, the transfer material enters into a fixing nip (fixing position) N as an abut nip portion between a fixing roller 18 and a pressure roller 19 while being supported by a fixing inlet supporting portion (second supporting surface) 17 as a second transfer material supporting means, where the toner image is fixed to the transfer material. Thereafter, the transfer material is discharged onto a sheet discharge tray 21 by a pair of discharging rollers 20.

In the copying machine according to the illustrated embodiment, a minimum size of a transfer material capable of being used in the machine is 148 mm for longitudinal feeding of a post card, and a distance between a nip R between the registration rollers (first transfer material conveying means) 8 and the fixing nip (fixing position) N of the fixing device (second transfer material conveying means) 15 is selected to be 143 mm, smaller than the minimum size of 148 mm. Further, a distance between the nip R of the registration roller pair 8 and the transfer position T is selected to 43 mm.

After the transfer material is separated, transfer residual toner and foreign matters remaining on the surface of the photosensitive body 1 are removed by a cleaning device 10 (blade type in the illustrated embodiment) to clean the photosensitive body for preparing for next image formation.

Incidentally, the reference numeral 22 denotes a manual insertion sheet feed plate; 23 denotes a sheet feed roller; 24 denotes a friction separation pad urged against the sheet feed roller 23; 25 denotes an air discharge fan; and 26 denotes a filter member.

Further, the copying machine according to the illustrated embodiment includes a process cartridge into which three process equipment units (photosensitive body 1, primary charger 3 and cleaning device 10) are integrally incorporated and which can detachably be mounted to the main body of the copying machine. The process equipment units included in the process cartridge may comprise the photosensitive body (image bearing body) 1 and at least one of image forming process means for the photosensitive body.

And, (1) In the above-mentioned copying machine, the transfer supporting portion (first transfer material supporting means) 11, top portion 13 of the convey guide portion (third transfer material supporting means) and fixing inlet supporting portion (second transfer material supporting means) 17 are located on a substantially straight line X, as shown in the partial enlarged view of FIG. 2;

(2) The nip R of the registration roller pair 8 (first transfer material conveying means), transfer position T of the transfer means 6 and fixing nip (fixing position) N of the fixing device 15 are located on a substantially straight line Y;

(3) Three points (11, 13, 17) on the straight line X are disposed below three points (R, T, N) on the straight line Y;

(4) The transfer guide (fourth transfer material supporting means) 9 is located above the straight line Y; and (5) Further, when it is assumed that an actual speed (registration actual speed) of the registration roller pair 8 (first transfer material conveying means) is $V_A$, a rotational peripheral speed of the photosensitive body 1 is V, and an actual speed (fixing actual speed) of the fixing device 15 (second transfer material conveying means) is $V_B$, a relationship between these speeds becomes as follows:

$$0.99V<V_A<V<V_B<1.02V.$$

The actual speed $V_A$ of the registration roller pair 8 is a speed when the transfer material S is gripped only by the registration roller pair 8, and the pair of separation rollers 72 and the pair of pull rollers 73 which are disposed at an upstream side of the registration roller pair 8 in the transfer material conveying direction are in driven conditions to generate back tension, with the result that the speed of the registration roller pair becomes smaller than a calculated value accordingly.

Further, the actual speed $V_B$ of the fixing device 15 is a speed obtained by measuring the speed when the transfer material S is actually conveyed only by the pair of fixing rollers 18, 19 if the upper fixing roller 18 has reverse crown not to obtain the actual speed by calculation.

As in the above condition (1), when the three points (transfer supporting portion 11, convey supporting portion 13 and fixing inlet supporting portion 17) are disposed on the substantially straight line X, the transfer material S is conveyed in a substantially flat fashion along the straight line X without bending or curling, so that front and rear (with respect to the body of the apparatus) corners of the leading edge of the transfer material enter into the fixing nip simultaneously. Due to this simultaneity, since the fixing speed is slightly slower as is in the above condition (5) while keeping the flat condition of the transfer material S, the transfer material S is changed from the plane along the straight line X to the plane along the straight line Y, with the result that the transfer material eventually advances up to the point where the trailing edge of the transfer material leaves the nip R of the registration roller pair 8 while the transfer material is being subjected to the tension. At the moment when the trailing edge of the transfer material leaves the nip R of the registration roller pair 8, although the trailing edge of the transfer material has play more or less, as is in the above condition (4), since the transfer guide 9 urges the transfer material toward the photosensitive body 1, the play is minimized. As is in the above condition (5), since the fixing speed is always slightly slower to eliminate the returning (spring back) of the transfer material, leaving shock (registration leaving shock) does not occur, when the trailing edge of the transfer material S leaves from the registration roller 8. In this case, when a difference in speed between the fixing device 15 and the registration roller pair 8 is selected within a condition range shown in FIGS. 3A and 3B, the registration leaving shock does not occur. Now, such a condition range will be explained.

Figure 3A:
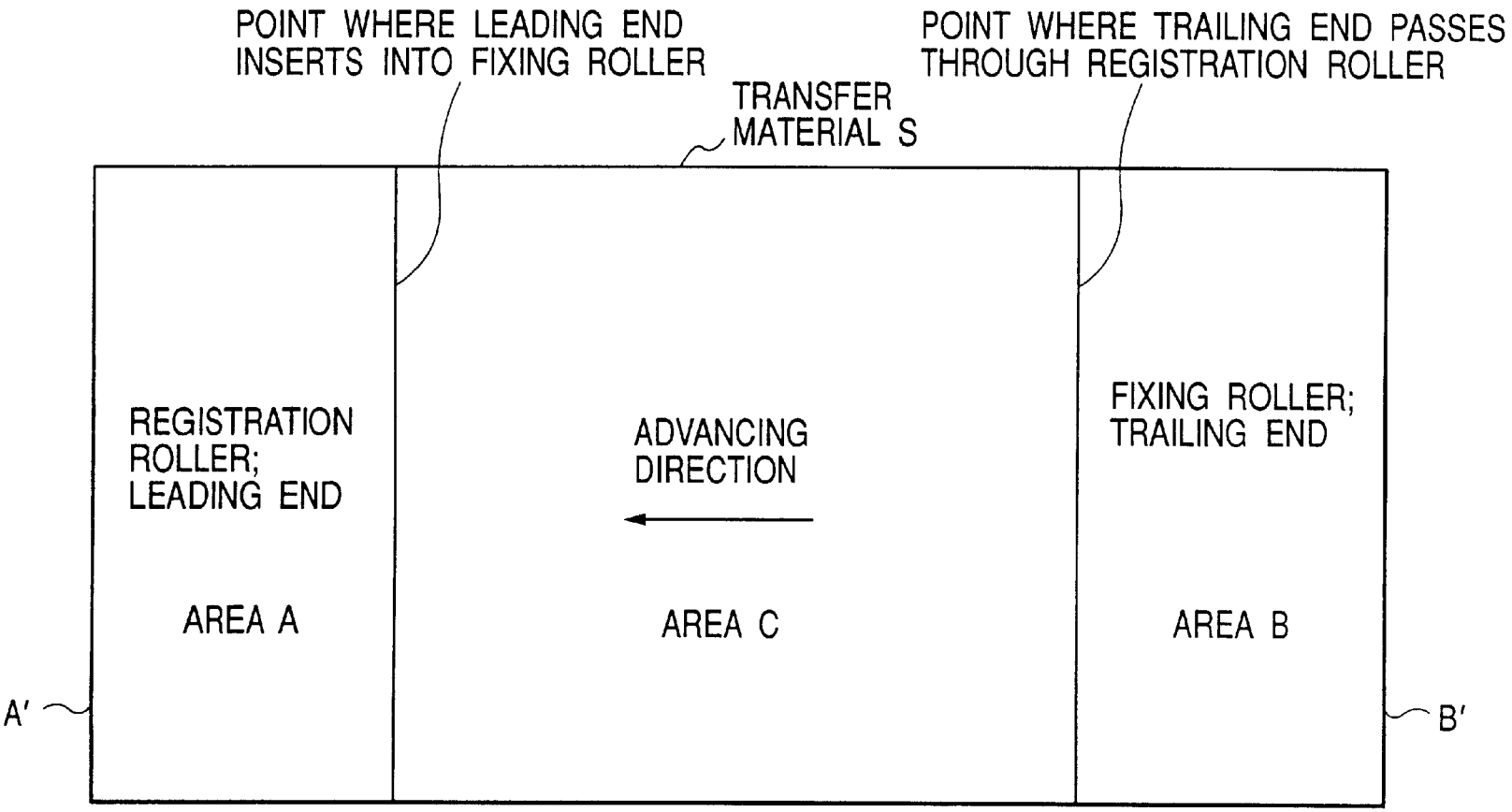
FIGS. 3A and 3B are explanatory views for explaining a transfer material conveying speed at registration rollers and a transfer material conveying speed at a fixing device.

FIG. 3A shows an image area formed on the transfer material S, where a left end A' corresponds to the leading edge (end) of the image in the transfer material advancing (conveying) direction and the right end B' corresponds to the trailing edge (end) of the image. The image area includes an area A (100 mm from the leading end) where the transfer material is conveyed only by the registration roller pair 8, an area B (43 mm from the trailing end) where the transfer material is conveyed only by the pair of fixing rollers 18, 19 of the fixing device 15, and an area C where the transfer material is being pulled by both the registration roller pair 8 and the pair of fixing rollers 18, 19 of the fixing device 15, and conveying speeds for the transfer material in these areas are selected as shown in FIG. 3B.

Figure 3B:
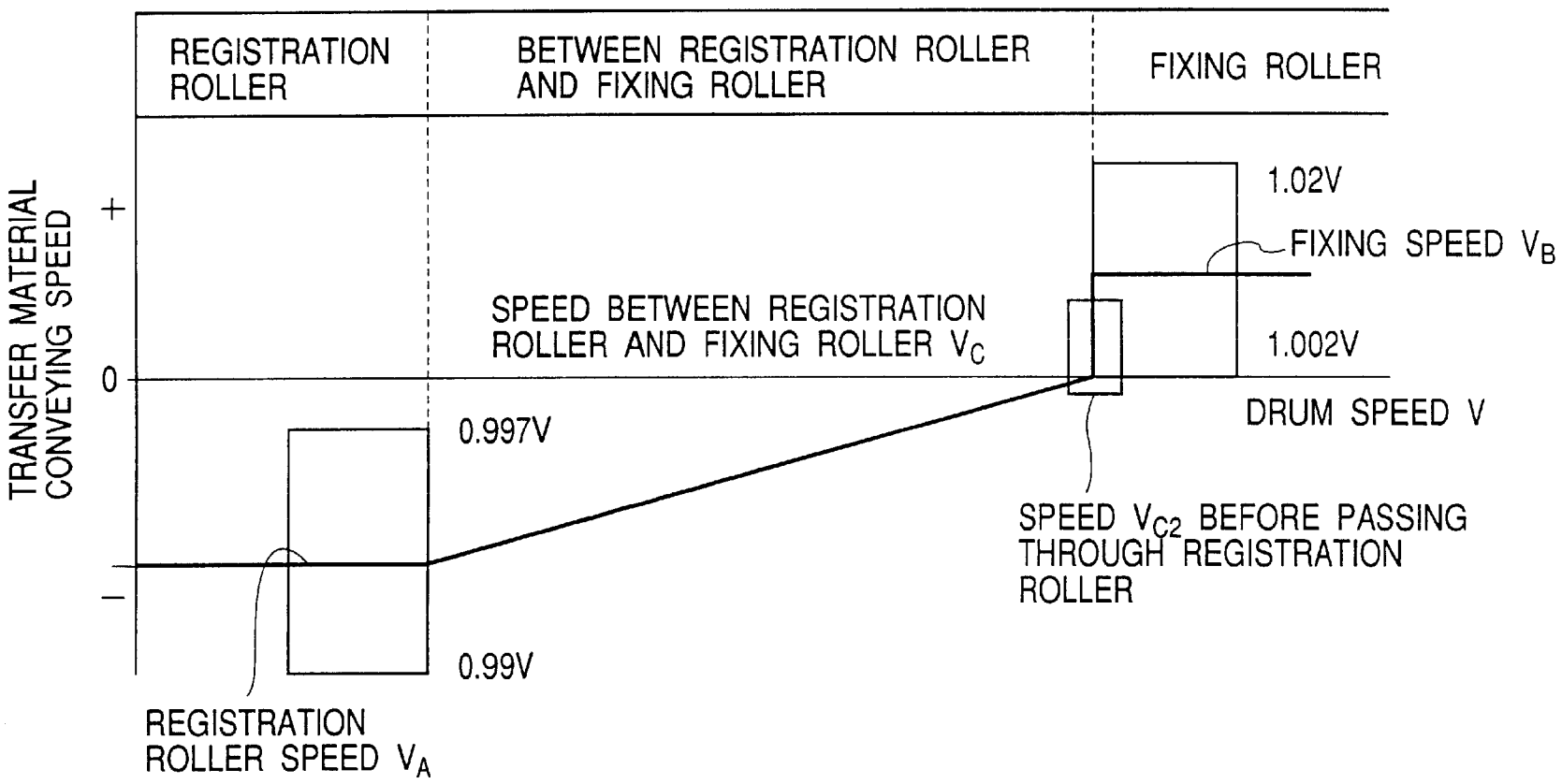

As shown in FIG. 3B, in consideration of dispersion in mass-production, the speed $V_A$ of the registration roller pair 8 is selected to 0.99 V to 0.997 V (V is rotational peripheral speed of the photosensitive body 1 (drum speed)).

The speed $V_B$ (fixing speed) of the fixing device 15 is selected to 1.002 V to 1.02 V.

Further, the speed $V_C$ between the registration roller pair and the fixing device is selected so that, after the leading edge of the transfer material enters into the fixing nip N, the transfer material is conveyed by the fixing device while slightly squeezing the transfer material and the speed is gradually increased from the registration speed $V_A$ to a speed $V_{C2}$ immediately before the trailing end of the transfer material leaves (passed through) the registration roller pair, which speed $V_{C2}$ is substantially the same as the drum speed V. After the trailing end of the transfer material leaves the registration roller pair, the transfer material is conveyed at the fixing speed $V_B$.

Within this condition range, the speed $V_{C2}$ immediately before the trailing end of the transfer material leaves the registration roller pair is substantially the same as the drum speed V and is nearer to the fixing speed $V_B$. Further, since the fixing speed $V_B$ is greater than the registration speed $V_A$, the spring back caused by slack of the transfer material at the transfer position T when the trailing end leaves the registration roller pair does not occur (because there is no slack due to the tension acting on the transfer material). Further, since the difference in speed between before and after the trailing end leaves the registration roller pair is small, transfer deviation does not occur.

On the other hand, transfer deviation due to excessive tension does not occur within this speed condition range. Further, since the entire magnification can be suppressed within 0.997 to 1.0, there is no problem.

Since the transfer material is always gripped by the registration roller pair 8, if the entering shock (fixing entering shock) caused when the leading edge of the transfer material enters into the fixing nip N occurs, such shock is small, which does not lead to transfer deviation.

Figure 4:
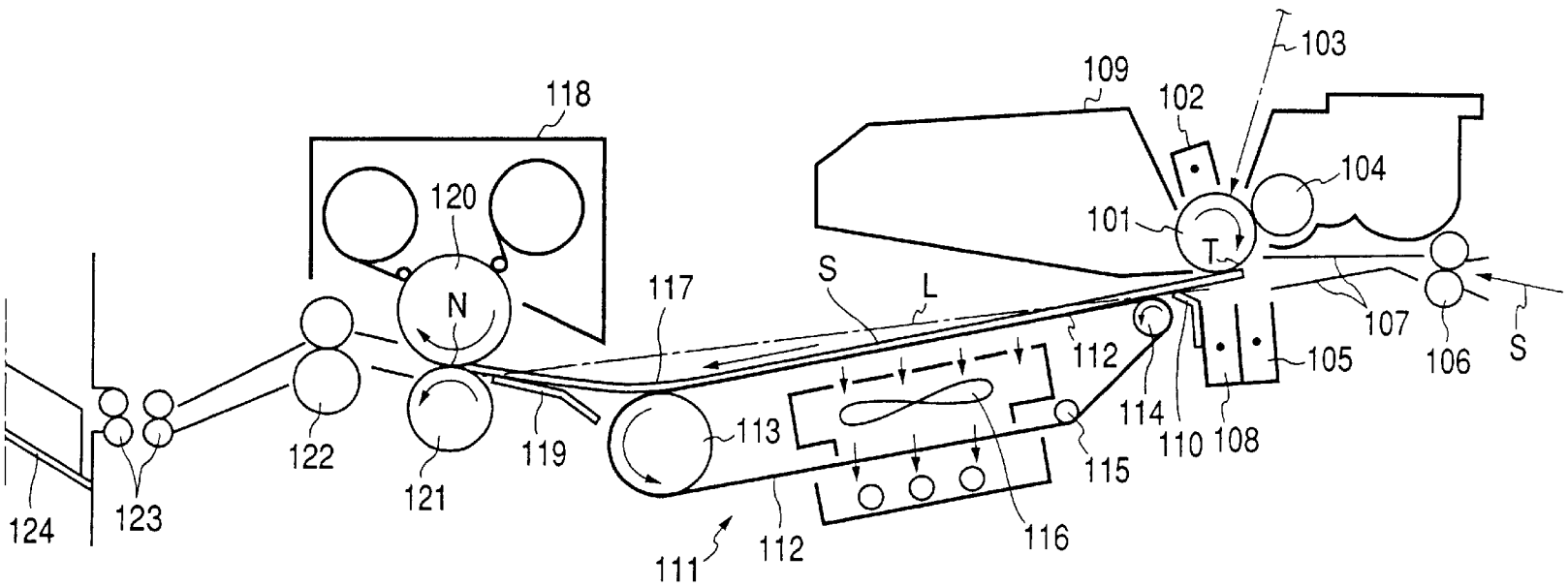
FIG. 4 PRIOR ART
FIG. 4 is a schematic constructional view of a conventional image forming apparatus having a bulky transfer material conveying device including a convey belt and a fan.

The conventional bulky convey portion (FIG. 4) having the fan and disposed between the transfer position and the fixing portion can be replaced by the compact fixed convey guide portion having no fan and no belt, thereby reducing the cost.

In the image forming apparatus according to the present invention, the first transfer material conveying means is not limited to the illustrated registration roller pair but may be a pair of convey rollers which are always rotated.

The material of the transfer material S is not limited to paper but may be plastic sheet, leather or cloth.

The image bearing body and the image forming process are not limited to electrophotographic type but may be of electrostatic recording type or magnetic recording type.

The image bearing body is not limited to the drum type but may be of rotary belt type or may be designed as a sheet-shaped image bearing body mounted on a rotary member.

The equipment such as the first charger 2, developing device 5, transfer charger 6 and fixing device 15 are also not limited to the illustrated ones.

As mentioned above, according to the present invention, in the image forming apparatus of transfer type, fixing entering shock and registration leaving shock is prevented by designing to omit a convey portion having a convey belt and a suction fan disposed between the transfer position T and the fixing position N, thereby making the image forming apparatus more compact and cheaper.

What is claimed is:

1. An image forming apparatus comprising:

transfer means for transferring a toner image born on an image bearing member onto a transfer material;

convey means for conveying the transfer material to a transfer position of said transfer means;

fixing means for fixing the toner image transferred by said transfer means onto the transfer material;

transfer material supporting means for supporting the transfer material between said transfer means and said fixing means;

a transfer guide for guiding the transfer material conveyed by said convey means to said image bearing body, wherein a nip of said convey means, the transfer position of said transfer means and a fixing position of said fixing means are located on a substantially straight line, wherein said transfer guide guides the transfer material so as to bring the transfer material into contact with said image bearing member above the straight line, wherein said transfer material supporting means is located under the straight line, wherein a conveying speed of said fixing means is greater than a conveying speed of said convey means, and wherein a distance between the nip of said convey means and the fixing position of said fixing means is shorter than a length of a minimum sized transfer material in a conveying direction.

2. An image forming apparatus comprising:

a transfer means for transferring a toner image and born on an image bearing body onto a transfer material;

a fixing means for fixing the toner image transferred by said transfer means onto the transfer material;

a first transfer material supporting means for supporting a non-transfer surface of the transfer material separated from said image bearing body at a transfer material outlet of said transfer means;

a second transfer material supporting means disposed at a transfer material inlet of said fixing means and adapted to support the non-transfer surface of the transfer material; and a third transfer material supporting means disposed between said first and second transfer material supporting means and adapted to support the non-transfer surface of the transfer material;

wherein said first, second and third transfer material supporting means are located on a substantially straight line and a transfer material supporting surface of said second transfer material supporting means is fixed, wherein said first, second and third transfer material supporting means are disposed below a nip line connecting a transfer position of said transfer means and a fixing position of said fixing means, wherein a transfer material conveying speed of said transfer material conveying means is equal to or smaller than a peripheral speed of said image bearing body, and the peripheral speed of said image bearing body is equal to or smaller than a transfer material conveying speed of said fixing means, and wherein, when it is assumed that the peripheral speed of said image bearing body is V, a following relationship is established:

0.99 V≦(transfer material conveying speed of said transfer material conveying means<V<(transfer material conveying speed of said fixing means≦1.02 V.

3. An image forming apparatus according to claim 2, further comprising a fourth transfer material supporting means disposed between said transfer material conveying means and the transfer position of said transfer means, wherein said fourth transfer material supporting means is disposed above said straight line.

4. An image forming apparatus according to claim 3, wherein a distance between said transfer material conveying means and said fixing means is smaller than a minimum size of a transfer material which can be conveyed in said image forming apparatus.

5. An image forming apparatus according to claim 2, wherein a distance between said transfer material conveying means and said fixing means is smaller than a minimum size of a transfer material which can be conveyed in said image forming apparatus.

6. An image forming apparatus according to claim 2, wherein said image bearing body comprises an electrophotographic photosensitive body.

7. An image forming apparatus according to claim 2, wherein said image bearing body and at least one of image forming process means acting on said image bearing body are constituted as a process cartridge detachably attachable to said image forming apparatus.

8. An image forming apparatus according to claim 7, wherein said process cartridge includes an electrophotographic photosensitive body, a primary charger for uniformly charging said photosensitive body, and a cleaning means for cleaning a surface of said photosensitive body after the toner image was transferred to the transfer material.

9. An image forming apparatus comprising:

a transfer means for transferring a toner image formed and born on an image bearing body which is rotated at a constant peripheral speed, onto a transfer material;

a first transfer material conveying means for conveying the transfer material to a transfer position of said transfer means; and a second transfer material conveying means for fixing the toner image transferred by said transfer means onto the transfer material while conveying the transfer material;

wherein a transfer material conveying speed $V_A$ of said first transfer material conveying means is equal to or smaller than a peripheral speed V of said image bearing body which is equal to or smaller than a transfer material conveying speed $V_B$ of said second transfer material conveying means, and, $0.99V \leqq VA < V \leqq V_B \leqq 1.02V$, wherein a third transfer material conveying speed $V_C$ during a period from when a leading edge of the transfer material reaches said second transfer material conveying means to when a trailing edge of the transfer material leaves a nip of said first transfer material conveying means is gradually increased from the transfer material conveying speed $V_A$ of said first transfer material conveying means, wherein a fourth transfer material conveying speed $V_{C2}$ immediately before the trailing edge of the transfer material leaves the nip of said first transfer material conveying means becomes substantially the same as the peripheral speed V of said image bearing body, and wherein a relationship in which V is nearly equal to $V_{C2}$ which is equal to or smaller than $V_B$ is established, wherein said transfer means, said first and second transfer material conveying means are located on a substantially straight line, and wherein said transfer means, said first and second transfer material conveying means are disposed below a nip line connecting a transfer position of said transfer means and a fixing position of said second transfer material conveying means.

10. An image forming apparatus according to claim 9, wherein said first transfer material conveying means comprises a registration roller.

* * * * *

UNITED STATES PATENT AND TRADEMARK OFFICE

CERTIFICATE OF CORRECTION

PATENT NO. : 6,278,859 B1
DATED : August 21, 2001
INVENTOR(S) : Toshiyuki Nagano It is certified that error appears in the above-identified patent and that said Letters Patent is hereby corrected as shown below:

Column 1,
Line 22, “bearing 101” should read -- bearing body 101 --.

Column 2,
Line 30, “absorbing” should read -- adsorbing --.

Column 3,
Line 13, “= registration roller speed” should read -- ≅registration roller speed --; and
Line 45, “an d” should read -- and --.

Column 7,
Line 22, “charger 6,” should read -- means 6. --; and
Line 45, “charger 6” should read -- means 6 --.

Column 9,
Line 23, “is” (second occurrence) should be deleted;
Line 33, “is” should be deleted;
Line 36, “is” (second occurrence) should be deleted;
Line 62, “to” (first occurrence) should read -- to be --; and
Line 65, “to” (first occurrence) should read -- to be --.

Column 10,
Line 50, “charger 6” should read -- means 6 --.

Column 11,
Line 3, “means;” should read -- means; and --;
Line 5, “body,” should read -- body; --;
Line 57, “means<V<(transfer” should read -- means)<V<(transfer --;
Line 58, “means≤1.02” should read -- means)≤1.02 --; and

UNITED STATES PATENT AND TRADEMARK OFFICE

CERTIFICATE OF CORRECTION

PATENT NO. : 6,278,859 B1 
DATED : August 21, 2001
INVENTOR(S) : Toshiyuki Nagano It is certified that error appears in the above-identified patent and that said Letters Patent is hereby corrected as shown below:

Column 12,
Line 21, "was" should read -- is --;
Line 38, "$0.99V \leq VA < V \leq V_B \leq 1.02V$," should read -- $0.99V \leq V_A < V \leq V_B \leq 1.02V$, --;
Line 50, "means" should read -- means, --; and
Line 51, "and" should be deleted.

Signed and Sealed this

Sixteenth Day of July, 2002

*Attest:*

*Attesting Officer*

JAMES E. ROGAN
*Director of the United States Patent and Trademark Office*